United States Patent [19]

Gazda

[11] 4,181,344

[45] Jan. 1, 1980

[54] RUNNING TOOL

[75] Inventor: Imre I. Gazda, Saginaw, Tex.

[73] Assignee: Otis Engineering Corporation, Dallas, Tex.

[21] Appl. No.: 908,714

[22] Filed: May 23, 1978

[51] Int. Cl.[2] ..... E21B 23/04; F16F 9/18

[52] U.S. Cl. ..... 294/86.18; 64/23; 166/125; 267/125; 294/86.25

[58] Field of Search ..... 294/86.1, 86.15, 86.17, 294/86.18, 86.24, 86.25; 64/23; 166/125, 181, 182; 175/297, 321; 267/125

[56] References Cited

U.S. PATENT DOCUMENTS

| | | | |
|---|---|---|---|
| 2,980,464 | 4/1961 | Poteet | 294/86.17 |
| 2,984,302 | 5/1961 | Church | 294/86.15 X |
| 3,208,788 | 9/1965 | Roark | 294/86.15 |
| 3,606,297 | 9/1971 | Webb | 267/125 |
| 4,007,798 | 2/1977 | Gazda | 175/297 |
| 4,035,011 | 7/1977 | Gazda | 294/86.18 |

*Primary Examiner*—Johnny D. Cherry
*Attorney, Agent, or Firm*—Vinson & Elkins

[57] ABSTRACT

Disclosed is a running tool for running sensitive well equipment into a well. Once the well equipment has been landed in the well, the running tool releases therefrom upon the application of a steady force. This abstract of the disclosure is neither intended to define the scope of the invention which, of course, is measured by the claims, nor is it intended to limit the invention in any way.

8 Claims, 4 Drawing Figures

RUNNING TOOL

BACKGROUND OF THE INVENTION

1. Field of the Invention

This invention relates to running tools for well equipment which are retrieved once the well equipment has been landed in the well. The running tool of this invention may be used with sensitive well equipment that cannot withstand jarring action.

2. The Prior Art

Running tools generally form a portion of a well tool train. Well equipment is run through the well and positioned therein by the running tool. Once the equipment is positioned in the well, the running tool releases therefrom. The well equipment is left in the well. The remaining portion of the well tool train, including the running tool, is retrieved from the well.

Many running tools include telescopable members which are held in a running position by a shear pin. Once the well equipment has been landed in the well, the train is manipulated to impose a jarring force upon the running tool. The jarring force shears the shear pin. The telescopable members of the running tool telescope to a releasing position. The running tool releases from the landed well equipment and is retrieved from the well. Examples of running tools which rely upon jarring action to release them from the landed and locked well equipment are illustrated on pages 3987 and 3988 of the 1974–75 edition of the "COMPOSITE CATALOG OF OILFIELD EQUIPMENT AND SERVICES".

Many tools can be landed within a well and withstand the jarring action required to lock them in position and/or release the running tool. However, some bottom hole pressure gauges and temperature gauges and other such instruments are extremely delicate. Jarring action to either land such equipment in the well or release the running tool from the landed equipment would damage the instrument, affect the instrument's calibration, and/or otherwise render the instrument incapable of performing its function. Running tools which require jarring action to release from the landed well equipment simply cannot be used with such instruments.

A running tool, structured in accordance with the disclosure of U.S. Letters Pat. No. 4,035,011 will release equipment in a well upon a steady application of force to the running tool. Spring means are utilized in the running tool disclosed in that patent to resist relative telescoping movement between components of the running tool. The tool disclosed in U.S. Letters Pat. No. 4,035,011 generally functions satisfactorily to run, land, and release from delicate well equipment. However, the tool does have several limitations. First, when the running tool is used in a wire line tool train, the weight of the equipment which can be supported by the running tool is limited to approximately 35 pounds. Second, the spring force would have to be carefully calculated and adjusted for different weight equipment. The maximum spring force is limited by the tensile strength of the wire line. The minimal spring force must be greater than the weight of the supported equipment and also must be greater than impulsive forces created when the tool train passes through a restriction. Otherwise, the supported well equipment will be released by the running tool prior to being landed in position. Third, a single running tool cannot be easily rendered compatible with different size well equipment. A different sized running tool is required for each different sized set of well equipment.

U.S. Letters Pat. No. 4,007,798 discloses a hydraulic jar including two interconnected hydraulic chambers having a change of fluid therein. Fluid flow in a first direction between the two hydraulic chambers is restricted and flow in a second direction is permitted.

OBJECTS OF THE INVENTION

An object of this invention is to provide a running tool having the advantages of a running tool as disclosed in U.S. Letters Pat. No. 4,035,011 without the aforementioned limitations.

Another object of this invention is to provide a running tool including yieldable urging means for resisting telescoping movement among components thereof and energy dissipiation means so that impulsive forces applied to the running tool are substantially absorbed by the energy dissipation means rather than by the yieldable urging means.

Another object of this invention is to provide a running tool which releases from landed well equipment upon the application of a steady force thereto and which does not release from the supported well equipment upon the application of an impulsive force thereto even if that impulsive force is greater than the yieldable force urging the running tool components to their running position.

Another object of this invention is to provide a running tool which releases from landed well equipment upon the application of a steady force thereto and which may be readily adaptable to different sized well equipment without altering the operating mechanism of the running tool.

These and other objects and features of advantage of this invention will be apparent from the drawings, the detailed description, and the appended claims.

BRIEF DESCRIPTION OF THE DRAWINGS

In the drawings, wherein like numerals indicate like parts and wherein an illustrative embodiment of this invention is shown.

BRIEF DESCRIPTION OF THE PEFERRED EMBODIMENT

Figure 1:
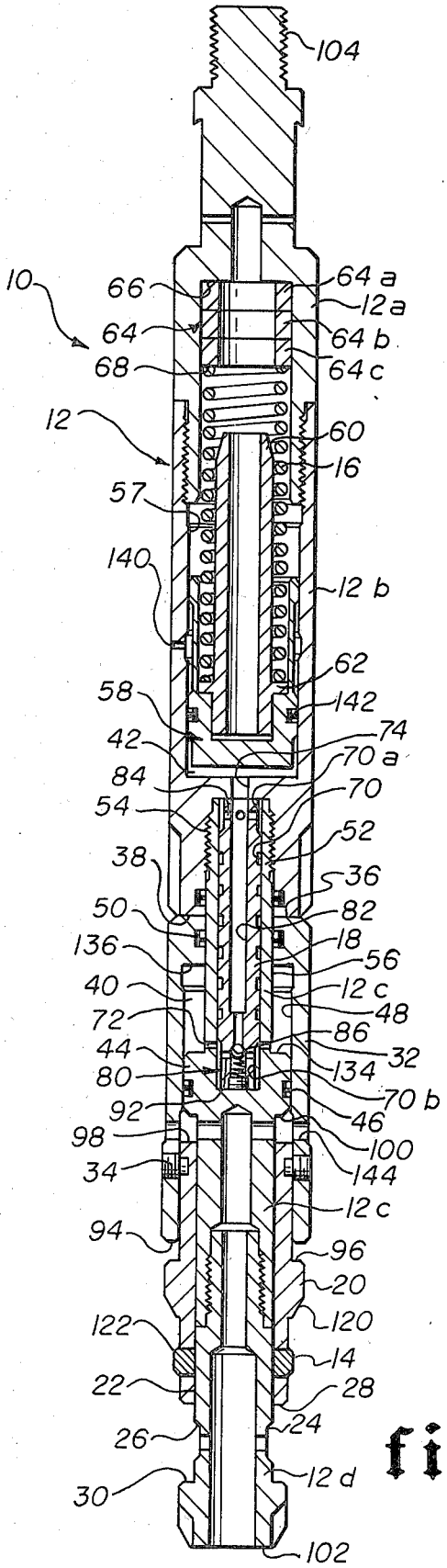
FIG. 1 is a longitudinal sectional view of the running tool of this invention with the tool in the running position.

The running tool 10 is positioned in a well tool train and is used to place well equipment in a well. The running tool 10 engages the well equipment to be placed in the well and supports the equipment as the tool train is being run through the well. Once the equipment reaches the desired location in the well, it is landed and locked therein. The running tool 10 thereafter releases from the well equipment and is retrieved from the well with the remaining portion of the tool train.

The running tool 10 of this invention may be utilized with either a wire line or a pumpdown tool train. However, the tool 10 was designed to overcome particular problems associated with running, landing, locking and releasing from delicate well equipment with a wire line tool train. Delicate equipment, such as bottom hole pressure gauges, temperature/gauges and the like, cannot be subjected to jarring action to lock them in the well and/or release them from their running tool once they are locked in the well. Therefore, the running tool 10 is designed to release from locked well equipment upon the application of a steady force.

For a wire line tool train, the steady releasing force that may be applied to the running tool is limited by the tensile strength of the wire line. Therefore, the strength of the means maintaining the telescoping members of the running tool 10 in their running position, which means is overcome to release the running tool 10 from the landed well equipment, is less than the strength of the wire line.

On the other hand, the means maintaining the running tool 10 in its running and equipment engaging position must be stronger than the force applied to the running tool due to the weight of the suspended and supported well equipment. Additionally, as a wire line tool train passes downwardly through a well, impulsive forces are generated. For example, a restriction will slow down the movement of the wire line tool train. However, at the surface additional wire line is continuing to be played out. Once the tool train passes through the restriction, it accelerates. The acceleration is abruptly stopped when the wire line again becomes taut and is stretched. The abrupt stoppage of the tool train results in an impulsive tensile force being applied to the running tool. If the running tool components extend sufficiently due to the impulsive force, the supported well equipment could be released therefrom. As the weight of the supported equipment increases, the impulsive force created due to passage through restrictions increases. The running tool 10 includes energy dissipation means so that the yieldable means maintaining the running tool in its running and equipment engaging position does not have to resist the impulsive force by itself.

Thus, the running tool 10 of this invention obtains the operating advantages of the running tool disclosed in the aforementioned U.S. Letters Pat. No. 4,035,011 without its disadvantages. The strength of the yieldable means maintaining the running tool 10 in a running position is greater than the weight of the supported equipment and less than the strength of the wire line. However, the yieldable means of running tool 10 does not have to have a strength greater than impulsive forces which will be applied to the running tool 10. Therefore, whereas the running tool disclosed in the aforementioned United States Letters Patent could only support equipment weighing approximately 35 pounds, the running tool 10 of this invention can support equipment weighing approximately 140 pounds. The supported equipment is still released from the running tool 10 upon the application of a steady force thereto.

Figure 2A:
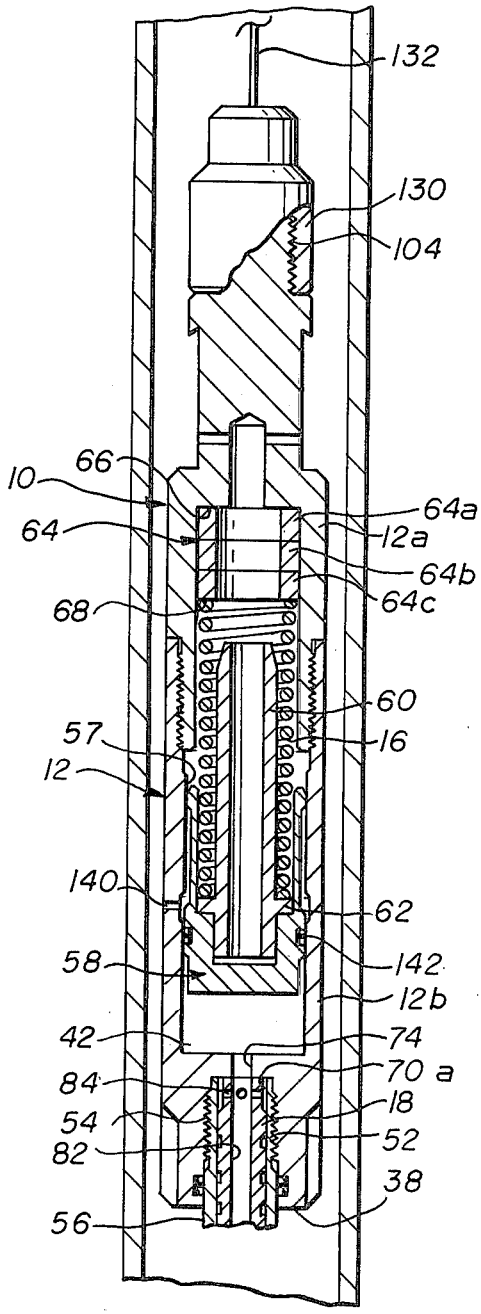
FIGS. 2A and 2B are a longitudinal sectional view of the tool of FIG. 1 in its operational environment showing the running tool just prior to releasing from landed equipment in a well.
Figure 2B:
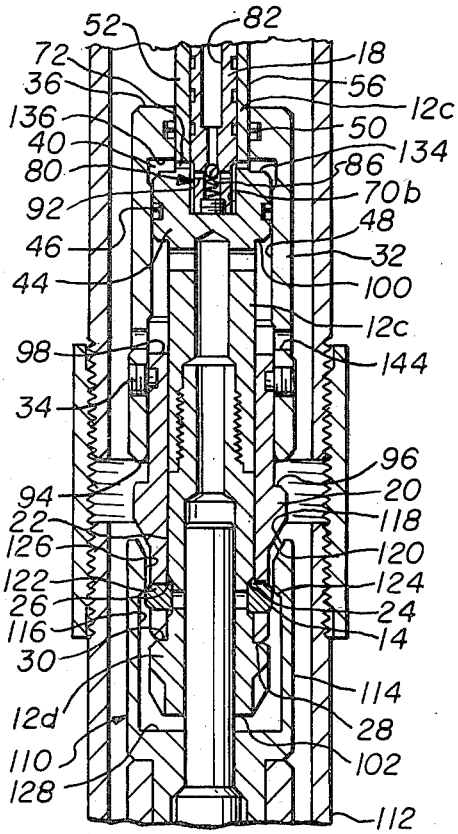
Figure 3:
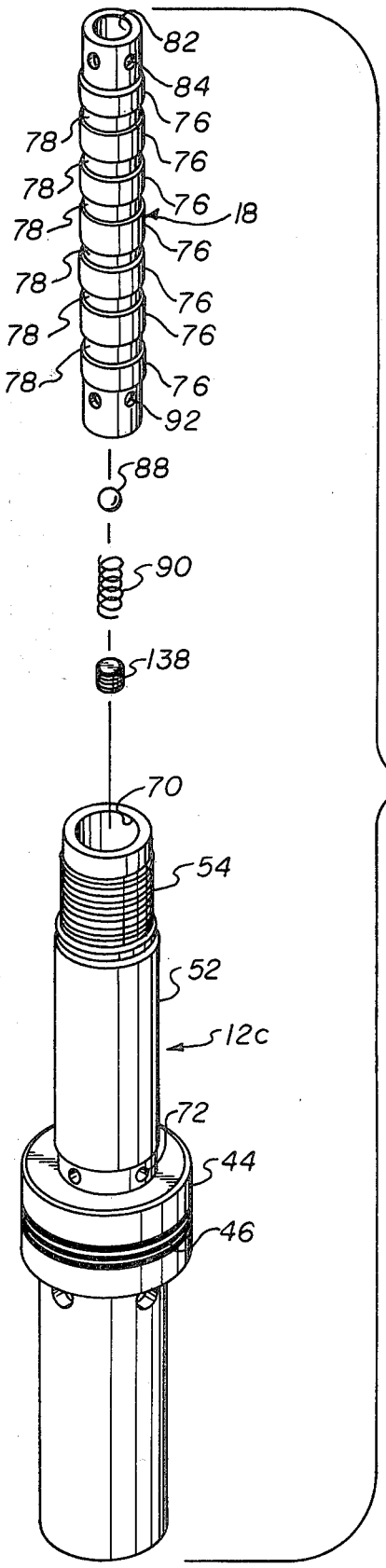
FIG. 3 is an exploded elevational view of some components of the running tool of FIG. 1.

The running tool 10 includes elongate body means 12. Tool engaging means 14 is carried by the body means 12 and is telescopable with respect to the body means 12 between a first tool engaging position (see FIG. 1) and a second tool releasing position (see FIG. 2B). Normally, tool engaging means 14 is yieldably urged to its first position by yieldable urging means 16. Energy dissipation means 18 absorbs some of the energy of impulsive forces imparted to the running tool 10. Even though the impulsive forces may be more powerful than the force of the yieldable urging means 16, the tool engaging means 14 is not moved thereby to its second position. However, a steady force application will be able to overcome the yieldable urging means 16 and cause the tool engaging means 14 to telescope to its second position.

Body means 12 is elongated. Other components of the running tool 10 are carried thereby, moved with respect thereto, and/or are supported thereby. The illustrated body means 12 is formed from interconnected body sections 12*a*, 12*b*, 12*c*, and 12*d*.

Tool engaging means 14 are carried by body means 12 and are movable with respect thereto between a first, tool engaging position (see FIG. 1) and a second, tool releasing position (see FIG. 2). The relative movement between body means 12 and tool engaging means 14 is telescopic and radial. When body means 12 and tool engaging means 14 are in their first position, they are in a telescopic collapsed position. The second relative position of body means 12 and tool engaging means 14 is their telescopic extended position. The tool engaging means 14 may comprise the illustrated lug means 14. Carrier means 20 carries lug means 14 on body means 12. The body means 12 includes means 22 for maintaining the lug means 14 in a tool engaging position and means 24 for permitting the lug means 14 to assume a tool releasing position. The body section 12*d* is an expander and retracter means section. The section 12*d* includes expander surface means 22 for maintaining the lug means 14 expanded radially outwardly and in their tool engaging position. The section 12*d* also includes retracter recess means 24 into which the lug means 14 are radially retractable. Once retracted within the retracter recess means 24, lug means 14 are in a position to release from any well equipment being supported by the running tool 10. Extending between the expander surface means 22 and the retracter recess means 24 is cam surface means 26. The lug means 14 are cammed radially outwardly by cam surface means 26 during movement from their second position towards their first position.

The longitudinal length of the expander surface means 22 is such that the tool engaging means 14 may undergo limited telescoping movement from their first position towards their second position without assuming a tool releasing position. For the illustrated running tool 10, the tool engaging means is moved approximately one inch from its first position before assuming a tool releasing position. The limited telescoping action between body means 12 and tool engaging means 14 permits the running tool 10 to withstand impulsive forces without releasing the supported well equipment.

Stop means limit the relative telescoping action between body means 12 and tool engaging means 14. Relative telescoping action between body means 12 and tool engaging means 14 towards their telescopic extended and tool releasing position is stopped by the engagement of the downwardly facing end surface 28 of carrier means 20 with the upwardly facing stop shoulder 30 of body section 12*d*. Normally, carrier means 20 is interconnected with cylinder means 32 by pin means 34. Cylinder means 32 is carried by body means 12 and is movable with respect thereto between a first telescopic collapsed position (see FIG. 1) and a second telescopic extended position (see FIG. 2B). While the carrier means 20 and cylinder means 32 are interconnected, telescoping movement between body means 12 and tool engaging means 14 towards their first telescopic collapsed and tool engaging position is limited by the engagement of the upwardly facing end surface 36 of cylinder means 32 with the downwardly facing stop shoulder 38 of body section 12*b*.

Normally, as long as cylinder means 32 is interconnected with carrier means 20, tool engaging means 14 are yieldably urged towards their first position with respect to body means 12. The yieldable urging force is due to the potential energy stored in yieldable urging means 16. The yieldable urging means 16 may be the coil compression spring means 16 shown. The force transmission between the yieldable urging means 16 and the tool engaging means 14 occurs through a charge of hydraulic fluid and the interconnected cylinder means 32 and carrier means 20. The running tool 10 includes two hydraulic chamber means 40 and 42 which are interconnected and which have a charge of hydraulic fluid confined therein. One 40 of the two hydraulic chamber means 40 and 42 is subjected to forces which tend to move tool engaging means 14 towards its second position. The other 42 of the two hydraulic chamber means 40 and 42, is subjected to the yieldable urging force which tends to move tool engaging means 14 towards its first position. Since the two hydraulic chamber means 40 and 42 are interconnected and since they confine a charge of hydraulic fluid, the pressure of the confined fluid is constant (at equilibrium) and a change in volume of either of the chamber means 40 and 42 results in an inverse corresponding change in volume of the other. Once the tool engaging means 14 is in its first position, the yieldable urging means 16 yieldably resists any change in volume for hydraulic chamber means 42. Force transmission between yieldable urging means 16 and tool engaging means 14 is as follows: First, the yieldable urging means 16 exerts a yielding force upon the fluid within hydraulic chamber means 42. The yieldable force is converted into a pressure. At equilibrium the pressure within hydraulic chamber means 40 is the same as the pressure within hydraulic chamber means 42. The charge of hydraulic fluid exerts a pressure force upon cylinder means 32. The pressure force urges cylinder means 32 to its first telescopic collapsed position abutting body section 12*b*. Cylinder means 32 transmits the force to pin means 34 which in turn transmits the force to carrier means 20. Finally, carrier means 20 transmits the force to lug means 14.

Body means 12 and cylinder means 32 define the one hydraulic chamber means 40. Body section 12*c* is a piston means section. Piston head means 44 is formed thereon and carries seal means 46. Cylinder means 32 has an inwardly facing smooth cylinder wall means 48. Piston head means 44 is disposed within cylinder means 32. Seal means 46 engages wall means 48 and seals between piston means section 12*c* and cylinder means 32. Cylinder means 32 carries seal means 50. Piston means section 12*c* includes extension means 52 extending from piston head means 44, through seal means 50, and interconnecting with body section 12*b*. The means for interconnecting the extension means 52 of body section 12*c* with body section 12*b* may be the threads 54 shown. Extension means 52 includes a smooth outwardly facing surface 56 which is engaged by seal means 50. Seal means 50 seals between cylinder means 32 and the extension means portion 52 of body section 12*c*. Thus, a confined annular chamber for the one hydraulic chamber means 40 is defined by cylinder means 32 and the piston means section 12*c* of body means 12 between seal means 46 and seal means 50.

The body means 12 defines the other hydraulic chamber means 42. Body section 12*b* is a chamber housing means section. The chamber housing means section 12*b* has a longitudinally extending inner chamber means 57. The hydraulic chamber means 42 occupies a portion of the inner chamber means 57. The remaining portion of the inner chamber means 57 is separated from the hydraulic chamber means 42 by means 58 which confine fluid within hydraulic chamber means 42 and permit the size of hydraulic chamber means 42 to be varied. The means 58 may be the balance piston means 58 shown.

The force of the yieldable urging means 16 is transmitted to the balance piston means 58. Preferably, guide means 60 is utilized to maintain the yieldable urging coil spring means 16 aligned. If the yieldable urging spring means 16 assumed a kinked over and misaligned position, all of the potential energy stored by the yieldable urging means 16 would not be available for yieldably urging the tool engaging means 14 towards its first position. Guide means 60 extends longitudinally within the spiral bore of coil spring means 16. Guide means 60 includes an ear 62 which engages balance piston means 58 and is in turn engaged by one end of coil spring means 16. The other end of coil spring means 16 engages adjustment means 64 associated with body 12. The adjustment means 64 adjusts the confined longitudinal length of coil spring means 16. Thus, for a given coil compression spring means 16 having a specified spring rate and a relaxed longitudinal length, the adjustment means 64 adjusts the potential energy of spring means 16. For different levels of potential energy, different forces are exerted by the yieldable urging means 16 on the confined charge of fluid within the two hydraulic chamber means 40 and 42. The adjustment means 64 may be the spacer ring means 64*a*, 64*b* and 64*c* shown. If no spacer ring means were utilized, spring means 16 would be confined between the downwardly facing shoulder 66 of body means 12 and ear means 62 of guide means 60. If a spacer ring means is utilized, spring means 16 is confined between the downwardly facing end surface 68 of the lowermost spacer ring means 64*c* and ear 62.

Passage means interconnects the two hydraulic chamber means 40 and 42. The extension means 52 of piston means section 12*c* has formed therein blind bore means 70. Blind bore means 70 extends between a location within chamber housing means section 12*b* where it has one end 70*a* and a location adjacent the one hydraulic chamber means 40 where it has another end 70*b*. Lateral port means 72 extends through extension means 52 and communicates between the one hydraulic chamber means 40 and blind bore means 70. Chamber housing means section 12*b* has formed therein aperture means 74 extending between the other hydraulic chamber means 42 and blind bore means 70.

In the absence of an external tensile force tending to move the body means 12 and the tool engaging means 14 to their second telescopic extended position, the running tool 10 is maintained in its first telescopic collapsed configuration. The force exerted by yieldable urging means 16 is transmitted to the confined change of fluid within the two, interconnected hydraulic chamber means 40 and 42. The pressurized charge of fluid maintains the upper end surface 36 of cylinder means 32 in abutment with shoulder means 38 of body means section 12*b*. Due to the interconnection between cylinder means 32 and carrier means 20, tool engaging means 14 is maintained disposed around expanding surface means 22. Whenever a tensile force is applied to the running tool 10 which tends to move the body means 12 and the tool engaging means 14 to their second telescopic extended position, fluid will be transferred between the two hydraulic chamber means 40 and 42. Upon a sufficient transfer of fluid from the one hydraulic chamber means 40 to the other hydraulic chamber means 42, body means 12 and tool engaging means 14 will assume their second telescopic extended position. Tool engaging means 14 will then be disposed around retractor recess means 24.

Energy dissipation means 18 prevents an impulsive tensile force, even if that force is greater than the force applied by yieldable urging means 16, from moving the tool engaging means 14 to its second fully telescopic extended position and permits a steady tensile force, which is greater than the force of yieldable urging means 16, to move the tool engaging means 14 to its second telescopic extended position. The energy dissipation means 18 restricts fluid flow between the two hydraulic chamber means 40 and 42 which occurs during movement of the tool engaging means 14 towards their telescopic extended position. In addition to restricting that passage of fluid, the energy dissipation means 18 converts the energy of the moving fluid to heat so that by the time the fluid enters chamber means 42 its energy is substantially reduced and at non-equilibrium conditions, the pressure of fluid within chamber means 42 is less than the pressure of fluid within chamber means 40. The yieldable urging means 16 may give somewhat due to the slight relative increase in pressure in chamber means 42. However, impulsive tensile forces cannot enlarge the volume of hydraulic chamber means 42 sufficiently to permit the tool engaging means 14 to assume their second fully telescopic extended position. Instead, lug means 14 remain expanded and in a tool engaging position due to the length of expander surface means 22.

The energy dissipation means 18 comprises choke means 18 disposed within the blind bore means 70. Choke means 18 includes multiple land means 76. The relative cross-sectional area of land means 76 and blind bore means 70 is such that a highly restricted passage means exists therebetween. Choke means 18 also includes a plurality of recess means 78 between the land means 76. Fluid flow through the passage means will result in alternate compression and decompression of the fluid. The fluid is compressed as it flows between the land means 76 and the blind bore means 70. The fluid is decompressed as it enters one of the groove means 78. The alternating compression and decompression of the fluid flowing through the passage means converts the energy of the moving fluid to heat energy. As the acceleration rate with which it is attempted to transport fluid from the one hydraulic chamber means 40 to the other hydraulic chamber means 42 increases, the ratio of energy dissipated to the energy of the fluid entering the chamber means 42 increases.

Check valve means 80 permits substantially only restricted fluid flow through the passage means in a first direction between the two hydraulic chamber means 40 and 42 and permits freer fluid flow through the passage means in a second direction. The first direction where substantially only restricted fluid flow is permitted is the direction the fluid moves during the telescopic extension of body means 12 and tool engaging means 14. Fluid movement through the passage means during the telescopic collapsing of body means 12 and tool engaging means 14 is not prevented by the check valve means 80, is substantially freer than the restricted flow permitted during telescopic extension and is in fact substantially unrestricted. Choke means 18 includes longitudinally extending bore means 82. Bore means 82 is substantially aligned with aperture means 74 and communicates therewith. If desired, lateral port means 84 may extend through choke means 18 and communicate between bore means 82 and the one end 70*a* of blind bore means 70. Seat means 86 for the check valve means 80 is formed around bore means 82. Ball means 88 of the check valve means 80 is resiliently biased by means 90 to a position engaging seat means 86. Orifice means 92 extends laterally through choke means 18 between bore means 82 and the other end 70*b* of blind bore means 70. For fluid flow through the passage means in a first direction, orifice means 92 is on the upstream side of ball means 88. Flow through the check valve means 80 in a first direction would thus be prevented.

Pin means 34 interconnects carrier means 20 and cylinder means 32 and permits emergency separation of carrier means 20 and cylinder means 32. Once carrier means 20 has been separated from cylinder means 32, the tool engaging means 14 may assume its second, tool releasing position regardless of fluid transfer between the two hydraulic chamber means 40 and 42. To permit separation of carrier means 20 and cylinder means 32, pin means 34 are shear pin means and form a releasable interconnection between carrier means 20 and cylinder means 32. The application of a select force will shear shear pin means 34 and release carrier means 20 from cylinder means 32. Since a tensile force applied to body means 12 and tool engaging means 14 tends to move these elements to their second telescopic extended position, the select force which shears pin means 34 is preferably a compressive force. A force tending to telescopically compress body means 12 and tool engaging means 14 is positively transmitted to pin means 34. The abutment of the end surface 36 of cylinder means 32 with stop shoulder 38 of body means 12 positively transmits the force to cylinder means 32. Pin means 34 positively transmits the force to carrier means 20. A shearing force is exerted upon pin means 34 by carrier means 20 and cylinder means 32. The downwardly facing end surface 94 of cylinder means 32 is spaced from the upwardly facing shoulder 96 of carrier means 20 a distance sufficient to permit relative movement between carrier means 20 and cylinder means 32 for shearing of pin means 34. Likewise the upwardly facing end surface 98 of carrier means 20 is spaced from the downwardly facing surface 100 of piston head means 44 a distance sufficient to permit relative movement for shearing of pin means 34. Likewise, when the running tool 10 is supporting well equipment, the downwardly facing end surface 102 of body means 12 is spaced from any surface of the supported well equipment a distance sufficient to permit relative downward movement of body means 12 for shearing pin means 34.

The relative radial size of the tool engaging means 14, its carrier means 20, and the expander and retracter means section 12*d* can be changed without affecting the operating components of the running tool 10. Thus, the running tool 10 can be adapted for use with different sized equipment.

The upper body section 12*a* comprises connecting sub means. The connecting sub means 12*a* includes means, such as the threads 104 illustrated, for connecting the running tool 10 to the force exerting means of the well tool train.

In FIG. 2, the running tool 10 is shown in its operational environment. The running tool 10 has been utilized to run the depending well equipment 110, only a portion of which is shown, through a well tubing string 112. The well equipment 110 has been landed and locked in the tubing string 112 and the running tool 10 is shown releasing therefrom. The well equipment 110 may be the selective bomb hanger disclosed in U.S. Letters Pat. No. 3,018,277. The equipment 110 includes upwardly extending fishing neck means 114. Fishing neck means 114 includes inwardly facing recess means 116. A portion of a running tool, such as the running tool 10, extends into the fishing neck means 114 and engages the recess means 116. The well equipment 110 can thereafter be moved by the running tool 10 through the well. Fishing neck means 114 includes an upwardly facing upper end surface 118. Downwardly facing shoulder means 120 of carrier means 20 contacts the end surface 118. Tool engaging means 14 extend radially outwardly into recess means 116. The projecting upwardly facing surface 122 of the tool engaging means 14 is chamfered. The chamfered surface 122 engages a correspondingly chamfered surface 124 of the fishing neck means 114 which defines the upper extremity of recess means 116. An inwardly facing lip 126 is defined by fishing neck means 114 between end surface 118 and chamfered surface 124. When the tool engaging means 14 is in its first operative position with respect to the running tool body means 12, the fishing neck lip 126 is confined between stop shoulder 120 of carrier means 20 and chamfered surface 122 of lug means 14.

As has been heretofore explained, the downwardly facing end surface 102 of the running tool body means 12 is spaced from the upwardly facing shoulder 128 of fishing neck means 114 a distance sufficient to permit shearing of pin means 34.

Connecting sub means **12*a* of the running tool body means 12 is connected to wire line cap means 130. Extending from wire line cap means 130 is the conventional wire line 132. The wire line 132 is played out to run the running tool 10 and the well equipment 110 into the well. It is taken up to exert a steady force on body means 12. The exertion of such a force of at least a minimal value for a certain time interval will cause the body means 12 and tool engaging means 14** to assume relative fully telescopic extended position.

The running tool 10 is assembled to incorporate a charge of hydraulic fluid in the hydraulic chamber means 40 and 42 and to permit interconnection of the running tool 10 and the supported well equipment 110.

Prior to interconnection of components of the running tool 10, seals are positioned on their respective carrying members. Piston means section **12*c* is inserted into cylinder means 32 with extension means 52 extending through seal means 50. Piston means section 12*c* is slid into cylinder means 32 until the upper surface 134 of piston head means 44 engages the downwardly facing surface 136 of cylinder means 32**.

The check valve means 80 is installed into choke means 18. Ball means 88 is slid into bore means 82 until it engages seat means 86. Spring means 90 is positioned under ball means 88. Set screw 138 maintains spring means 90 and ball means 88 in position. Choke means 18 is inserted into blind bore means 70 of the extension means portion 52 of piston means section **12*c*. The piston means section 12*c* is interconnected with chamber housing means section 12*b* as at threads 54. The interconnected components are held upright and supported from chamber housing means section 12*b*. Hydraulic fluid is poured into inner chamber means 57. When the level of fluid reaches lateral port means 140, a sufficient volume is obtained. Balance piston means 58 is inserted into inner chamber means 57. Guide means 60 is positioned on balance piston means 58 and coil compression spring means 16 is positioned around guide means 60. If desired, spacer ring means 64 are positioned in connecting sub means 12*a* to adjust the potential energy which will be stored by spring means 16. For example, the time required to release equipment weighing 140 pounds will be the same as the time required to release equipment weighing 35 pounds if three spacer rings 64*a*, 64*b* and 64*c* are installed when the equipment weighs 140 pounds and no spacer rings are installed if the equipment weighs 35 pounds. Once the proper number of adjusting spacer ring means 64 have been added, connecting sub means 12*a* is interconnected with chamber housing means section 12*b***.

The two hydraulic chamber means 40 and 42 have now been charged with fluid. The equipment engaging portion of the running tool 10 can now be assembled. The lugs 14 are positioned within carrier means 20. Carrier means 20 is inserted between cylinder means 32 and piston body means **12*c*. The expander means section 12*d* is inserted through carrier means 20 and interconnected with the piston means section 12*c*. Carrier means 20 is still free to telescope with respect to body means 12. Carrier means 20 is moved until lug means 14 are disposed around retractor recess means 24. The fishing neck means 114 of the well equipment 110 to be supported by the running tool 10 is fitted over carrier means 20 and the retracted lug means 14. Fishing neck means 114 is utilized to telescope carrier means 20 with respect to body means 12 until shear pin means 34 can be installed. Shear pin means 34 are installed to interconnect cylinder means 32 and carrier means 20. The telescoping of carrier means 20 has moved lug means 14 to their tool engaging position. The well equipment 110 is now capable of being supported by the running tool 10 since the lip 126 of the fishing neck means 114 is confined between lug means 14 and shoulder 120 of carrier means 20. The running tool 10 is interconnected with the remaining portion of the tool train. For example, wire line cap means 130 may be connected to the threaded connecting means 104 of the connecting sub means section 12*a*. Through the wire line cap means 130, the running tool is connected to the force applying means of a wire line tool train, namely the wire line 132**.

In operation, the running tool 10 of this invention is utilized to run, land and lock well equipment 110 in a well and thereafter release from the locked well equipment 110. Upon being released from the locked well equipment 110, the running tool 10, together with the remaining portion of the tool train, is retrieved from the well.

The weight of the well equipment 110 that can be supported by the running tool 10 is limited by the force applied by the yieldable urging means 16. If the weight of the supported and suspended well equipment 110 applies a force which is greater than the force applied by the yieldable urging means 16, the running tool 10 will gradually assume its telescopic extended position. The weight of the supported and suspended well equipment 110, the spring rate or modulus of the yieldable urging means 16, and the extent of adjustment of the yieldable urging means 16 may be varied within limits. However, due to strength of materials, size limitations, and practical spring rates, an approximate maximum weight for the suspended and supported well equipment is 140 pounds. The force exerted by the yieldable urging means 16 is greater than 140 pounds. The weight of the supported and suspended well equipment 110 exerts a downwardly acting force upon the tool engaging means 14. That force is transmitted to carrier means 20, through pin means 34 to cylinder means 32 and affects the charge of hydraulic fluid within the one hydraulic chamber means 40. The yieldable urging force of coil compression spring means 16 is exerted through balance piston means 58 to the charge of hydraulic fluid within the other hydraulic chamber means 42. Since the two hydraulic chamber means 40 and 42 are interconnected, the fluid, at equilibrium, has a constant pressure. Since the yieldable urging force is greater than the equipment weight force, the pressure depends upon the yieldable urging force. Therefore, hydraulic fluid within the one hydraulic chamber means 40 will urge cylinder means 32 upwardly to its first position abutting body section 12*b* and will offset the weight force of the suspended well equipment 110.

While the running tool 10 is being run in the well, the two hydraulic chamber means 40 and 42 are balanced to the effect of external pressures. Port means 140 communicates through chamber housing means section 12*b* between the tubing string bore and that portion of the inner chamber means 57 extending above the confined hydraulic chamber means 42. Thus, the pressure of well fluids within the tubing string bore are affective across seal means 142 carried by balance piston means 58.

Port means 144 extend laterally through cylinder means 32. Port means 144 prevents hydraulic lock upon relative movement of the carrier means 20 with respect to both of cylinder means 32 and body means 12 once shear pin means 34 has sheared. Port means 144 also communicates between the tubing string bore and the interior of cylinder means 32 below piston head means 44. Preferably, seal means 46 and seal means 142 have the same seal effective area. Thus, a constant external well pressure will affect the two areas and the two resultant pressure forces will balance each other out. The net external well pressure force affecting the two hydraulic chamber means 40 and 42 will therefore be zero.

As the tool train is being run through the well tubing string 112, impulsive forces tending to move the running tool towards its second telescopic extended position will occur. The created impulsive forces will be proportional to the weight of the suspended well equipment 110. During downward movement through the tubing string 112, the tool train will encounter and pass through restrictions. Downward movement of the tool train is slowed, and may be temporarily suspended, by such restrictions. However, at the surface, additional wire line 132 is continuing to be played out. Therefore, when the tool train exits from the restriction in the tubing string 112, there will be some slack in the wire line 132. Downward movement of the tool train will accelerate since the wire line 132 will be ineffective to exert a restraining, upward acting force. The downward velocity of the tool train will continue to increase until the slack in the wire line 132 is taken up. When the slack is taken up, the tool train abruptly decelerates due to the restraining upward force imposed by the taut wire line 132. The abrupt deceleration of the tool train causes an impulsive force to be imparted to the running tool 10 which impulsive force tends to urge the running tool 10 towards its second telescopic extended position. Heretofore, a soft set running tool would most likely release its suspended and supported well equipment if the impulsive force was greater than the force of the yieldable urging means tending to maintain the running tool in its running position. However, because the running tool 10 incorporates energy dissipation means 18, the impulsive force may be greater than the force of the yieldable urging means 16 and the running tool 10 will not be likely to release the suspended well equipment 110.

An impulsive force created by abruptly decelerating the suspended well equipment 110 creates a downwardly acting force on lug means 14. That downwardly acting force is transmitted to carrier means 20, through pin means 34 and is exerted upon cylinder means 32. If the magnitude of the impulsive force is greater than the magnitude of the yieldable urging means 16, the lug means 14, carrier means 20 and cylinder means 32 will all begin moving towards a telescopic extended position with respect to body means 12. Movement of cylinder means 32 results in the displacement of hydraulic fluid from the one hydraulic chamber means 40 to the other hydraulic chamber means 42. However, the energy dissipation means 18 dissipates the energy of the moving fluid and prevents the full magnitude of the impulsive force from being applied to the yieldable urging means 16. Flow restriction means prevent a high velocity flow rate through the passage means between the two hydraulic chamber means 40 and 42. Additionally, the flow restriction means compress the flowing fluid. After being compressed, the fluid enters alternating decompression zones in the passage means. The alternating compression and decompression of the flowing fluid converts the energy of the flowing fluid to heat energy. The heat energy is ineffective for overpowering the yieldable urging means 16. Check valve means 80 prevents nonrestricted flow through the passage means from the one hydraulic chamber means 40 to the other 42. Thus, by the time the flowing fluid enters hydraulic chamber means 42 its energy is reduced and the pressure of fluid within chamber means 42 will be less than the pressure of fluid within chamber means 40. The yieldable urging means 16 may give slightly. However, since the impulsive force is short lived, the slight increase in volume in the hydraulic chamber means 42 will not be sufficient to permit the tool engaging means 14 to assume its fully telescopic extended position with respect to body means 12. Instead, the short lived impulsive force quickly ceases. Thereafter, the yieldable urging means 16 returns the tool engaging means 14 to its first position. Since the upper end surface 36 of cylinder means 32 is spaced from stop shoulder means 38 of body means 12 when the impulsive force ceases, returning the tool engaging means 14 to its telescopic collapsed position transfers fluid from hydraulic chamber means 42 to hydraulic chamber means 40. The yieldable urging means 16 pushes balance piston means 58 towards an equilibrium position. Balance piston means 58 reduces the size of hydraulic chamber means 42. Fluid from hydraulic chamber means 42 flows through the inner bore 82 of the passage means interconnecting the two hydraulic chamber means 40 and 42. Check valve means 80 permits that flow of fluid. The fluid entering hydraulic chamber means 40 moves cylinder means 32 towards its first position until the end surface 36 of cylinder means 32 engages stop shoulder means 38. The tool engaging means 14 are returned therewith to their telescopic collapsed position. The limited telescoping action of the tool engaging means 14 with respect to the body means 12 whenever an impulsive load is applied occurs without the tool engaging means 14 assuming a tool releasing position due to the longitudinal length of the expander surface means 22.

Once the suspended and supported well equipment 110 has been landed and locked in the tubing string 12, the running tool 10 is released therefrom by the application of a steady minimal force which is greater than the force of the yieldable urging means 16. For the application illustrated in FIGS. 2A and 2B, the wire line 132 would be taken up at the surface and a tension force developed therein. The tension force would be applied to body means 12 through wire line cap means 130. Since the well equipment 110 is locked in the tubing string 112, lug means 14, carrier means 20 and cylinder means 32 will remain stationary. The tension force acts upwardly on the body means 12 and pulls it upward with respect to the stationary tool engaging means 14. Upward movement of piston head means 44 within cylinder means 32 transfers fluid from the one hydraulic chamber means 40 to the other. Balance piston means 58 moves within chamber means 57 to enlarge the size of hydraulic chamber means 42 due to the additional fluid entering the chamber 42. Fluid flow is restricted through the passage means. Therefore, the upwardly acting force must be applied for a time sufficient to permit enough fluid transfer such that the body means 12 moves to its second telescopic extended position with respect to lug means 14. Sufficient fluid transfer should occur after 30 to 45 seconds of a steady, continuous force application. During the fluid transfer, check valve means 80 prevents nonrestricted flow through the passage means.

Once the body means 12 has been moved to its second telescopic extended position with respect to the tool engaging means 14, the tool engaging means 14 are able to move to a equipment releasing position. The tool engaging means 14 are disposed around retracting recess means 24. The interacting chamfered surface 122 of the tool engaging means 14 and chamfered shoulder 124 of the fishing neck means 114 cam lug means 14 radially inwardly into the retracting recess means 24. Once the lug means 14 have been cammed radially inwardly, they can pass through the lip 126 of the fishing neck means 114. The running tool 10 is pulled upwardly out of the fishing neck means 114. The running tool 10 and the tool train of which it is a part may now be retrieved from the well.

Once the running tool 10 has released from the landed and locked well equipment 110, the yieldable urging means 16 returns the tool engaging means 14 to its first telescopic collapsed position. Other than the weight of the running tool components, there will be no downwardly acting force exerted upon the tool engaging means 14, carrier means 20, pin means 34 and cylinder means 32. The force of the yieldable urging means 16 will be greater than the weight force of these components. Yieldable urging means 16 will push balance piston means 58 to an equilibrium position and balance piston means 58 will reduce the volume of hydraulic chamber means 42. The fluid from hydraulic chamber means 42 will be transferred to hydraulic chamber means 40 through bore means 82 and past check valve means 80. Upon entering hydraulic chamber means 42, the hydraulic fluid will push cylinder means 32 upwardly. Movement of cylinder means 32 ceases when its end surface 36 engages the stop shoulder means 38 of body means 12.

If the running tool 10 cannot be released from the landed and locked well equipment 110 through normal operations, the running tool 10 includes emergency means for releasing the tool engaging means 14 for relative movement with respect to body means 12. Pin means 34 may be sheared once the well equipment 110 is locked in the tubing string 112. To shear pin means 34 a downwardly acting force is imposed on body means 12. The downwardly acting force is transmitted from body means 12 to cylinder means 32 due to the abutment of the upper end of surface 36 of cylinder means 32 with stop shoulder means 38 of body means 12. That downwardly acting force is applied by cylinder means 32 to pin means 34. Stop shoulder means 120 of carrier means 20 is engaging the upwardly facing end surface 118 of fishing neck means 114. Therefore, when a downwardly acting force is imposed upon body means 12 an upwardly acting reactive force affects carrier means 20. The upwardly acting reactive force is also applied to pin means 34. When the opposing forces are great enough, pin means 34 shears. The spacings between the lower end surface 94 of cylinder means 32 and the upwardly facing shoulder 96 of carrier means 20 and between the upwardly facing end surface 98 of carrier means 20 and the downwardly facing shoulder 100 of piston head means 44 and between the downwardly facing end surface 102 of body means 12 and the upwardly facing shoulder of fishing neck means 114 are such that sufficient relative movement can occur to permit shearing of shear pin means 34. Once shear pin means 34 shears, relative movement between body means 12 and tool carrier means 20 is permitted. Body means 12 is moved upwardly. Relative movement of carrier means 20 ceases when the downwardly facing end surface 28 of carrier means 20 strikes the stop shoulder means 30 of body means 12. At that time, lug means are disposed around the retracting recess means 24. The camming action engagement between chamfered shoulder 122 of lug means 14 and shoulder 124 of fishing neck means 114 cams lug means 14 radially inwardly. Lug means can thereafter pass through the inwardly projecting lip 126 of the fishing neck means 114. The running tool 10 and the remaining portion of the tool train can be retrieved from the well.

From the foregoing, it can be seen that the objects of this invention have been obtained. An improved running tool which releases from landed and locked well equipment upon the application of a steady minimal force has been provided. Yieldable means urge telescoping components of the running tool to a collapsed position. The collapsed position is also the tool engaging and supporting position of the running tool. The force applied by the yieldable urging means is greater than the tool extending force exerted by the weight of the suspended equipment and may be less than impulsive tool extending forces which occur during running. Energy dissipation means of the running tool prevent the full magnitude of the impulsive forces from affecting and overpowering the yieldable urging means. Additionally, minor telescoping extension between the tool engaging means and the running tool body can occur without the tool engaging means releasing from the supported well equipment. A steady force which tends to extend the running tool will overpower the yieldable urging means and result in the running tool assuming its second fully telescopic extended position. In its extended position, the running tool releases from the supported well equipment. In an emergency, if normal releasing operations are ineffective, releasing means permit relative telescoping movement between the tool engaging means and the tool body means. That relative movement can occur without affecting the energy dissipation means and the yieldable urging means.

The foregoing disclosure and description of the invention are illustrative and explanatory thereof. Various changes in the size, shape, and materials, as well as the details of the illustrated construction, may be made within the scope of the appended claims without departing from the spirit of the invention.

What is claimed is:

1. A running tool comprising:
elongate body means;
means carried by said body means for engaging well equipment;
said body means including means for maintaining said engaging means in an equipment engaging position and means for permitting said engaging means to release equipment;
carrier means for carrying said engaging means on said body means and telescopable with respect to said body means between a first collapsed position wherein said engaging means is in an equipment engaging position and a second extended position wherein said engaging means is permitted to release equipment;
means for yieldably urging said carrier means to its first position; and
energy dissipation means for preventing the full magnitude of an impulsive force tending to move said carrier means towards its second extended position from being applied to said yieldable urging means and for permitting a steady force tending to move said carrier means towards its second position to overpower said yieldable urging means.

2. The running tool of claim 1 wherein said energy dissipation means includes:
one hydraulic chamber means having a variable volume dependant upon the relative position of said carrier means with respect to said body means;
another hydraulic chamber means;
passage means for interconnecting said one and said other hydraulic chamber means;
means for varying the volume of said other hydraulic chamber means;
means for restricting flow through said passage means and for dissipating the energy of fluid moving through said passage means during fluid movement between said one and said other hydraulic chamber means as said carrier means moves towards its second position;
check valve means for restricting flow through said passage means as said carrier means moves towards its second position and for permitting freer flow through said passage means as said carrier means moves towards its first position;
wherein said yieldable urging means resists movement of said volume varying means for said other hydraulic chamber means once said carrier means has assumed its first position and returns said volume varying means to a position wherein said carrier means is in its first position in the absence of a force tending to move said carrier means to its second position.

3. A running tool comprising:
elongate body means;
lug means for engaging well equipment;
carrier means for carrying said lug means and telescopable with respect to said body means between a first collapsed position wherein said lug means are in an equipment engaging position and a second extended position wherein said lug means are in an equipment releasing position;
one hydraulic chamber means having a variable volume dependent upon the relative telescoped position of said carrier means with respect to said body means;
another hydraulic chamber means;
passage means extending between said one and said other hydraulic chamber means;
means for restricting flow through said passage means in a first direction during movement of said carrier means towards its second position;
means for yieldably resisting a change in volume of said other hydraulic chamber means during movement of said carrier means towards its second position;
means for permitting freer flow through said passage means in a second direction.

4. The running tool of claim 3 additionally including
cylinder means carried by said body means and telescopable with respect to said body means;
means for interconnecting said cylinder means and said body means;
piston means formed on said body means and disposed in said cylinder means; and
wherein said one hydraulic chamber means is defined by said cylinder means, said body means and said piston means.

5. A running tool comprising:
elongate body means;
cylinder means carried by said body means and movable between a first position and a second position;
carrier means carried by said body means and telescopable with respect to said body means between a first collapsed position and a second extended position;
emergency release means for initially interconnecting said cylinder means and said carrier means and for releasing said carrier means from said cylinder means upon the application of a select force;
lug means carried on said body means by said carrier means;
said body means including expander and retracter means for expanding said lug means when said carrier means is in said first position and for permitting retraction of said lug means when said carrier means is in said second position;
said body means including piston means disosed in said cylinder means;
said piston means and said cylinder means defining one hydraulic chamber means;
said body means including chamber housing means for defining another hydraulic chamber means;
means for varying the volume of said other hydraulic chamber means;
passage means extending between said one and said other hydraulic chamber means;
means for yieldably resisting a change in volume of said other hydraulic chamber means from its volume wherein said cylinder means is in its first position; and means for restricting flow through said passage means and for dissipating the energy of fluid flowing through said passage means during movement of said cylinder means towards its second position and for permitting freer flow through said passage means during movement of said cylinder means towards its first position.

6. A running tool comprising:

body means adapted to be attached to the force applying means of a tool train;

cylinder means telescopable with respect to said body means between a first collapsed position and a second extended position;

lug means for engaging well equipment and movable with respect to said body means in response to movement of said cylinder means;

means associated with said body means for maintaining said lug means in a tool engaging position when said cylinder means is in said first position and for permitting said lug means to move to a tool releasing position when said cylinder means is in said second position;

means for resisting relative movement of said cylinder means with respect to said body means towards its second position and comprising:

one hydraulic chamber means defined by said cylinder means and said body means, another hydraulic chamber means defined by said body means, passage means for communicating between said one and said other hydraulic chamber means, means for restricting flow through said passage means as said cylinder means moves towards its second position, means for changing the volume of said other hydraulic chamber means, and means for yieldably resisting a change in volume of said other hydraulic chamber means as said cylinder means moves towards its second position.

7. A running tool comprising:

elongate body means;

lug means for engaging well equipment;

carrier means for carrying said lug means and telescopable with respect to said body means between a first collapsed position wherein said lug means are in an equipment engaging position and a second extended position wherein said lug means are in an equipment releasing position;

cylinder means carried by said body means and telescopable with respect to said body means between a first collapsed position and a second extended position and for defining one hydraulic chamber means;

said one hydraulic chamber means having a variable volume dependent upon the relative telescoped position of said cylinder means with respect to said body means;

means for interconnecting said cylinder means and said carrier means;

said body means defining another hydraulic chamber means;

passage means extending between said one and said other hydraulic chamber means;

means for dissipating the energy of fluid flowing through said passage means in a first direction during movement of said cylinder means towards its second position; and means for yieldably resisting a change in volume of said other hydraulic chamber means during movement of said cylinder means towards its second position.

8. The running tool of claim 7 wherein:

said interconnecting means is releasable upon the application of a select force thereto after which said carrier means is movable between its first and second positions without affecting said energy dissipation means and said yieldable resisting means.

* * * * *